US007961205B2

(12) United States Patent
Park et al.

(10) Patent No.: US 7,961,205 B2
(45) Date of Patent: Jun. 14, 2011

(54) DISPLAY APPARATUS CAPABLE OF MODIFYING IMAGE DATA FOR IMPROVED DISPLAY

(75) Inventors: Jae-Hyeung Park, Seoul (KR); Tae-Sung Kim, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 744 days.

(21) Appl. No.: 11/859,226

(22) Filed: Sep. 21, 2007

(65) Prior Publication Data

US 2008/0074414 A1 Mar. 27, 2008

(30) Foreign Application Priority Data

Sep. 22, 2006 (KR) ..... 10-2006-0092471

(51) Int. Cl.
*G09G 5/02* (2006.01)

(52) U.S. Cl. ..... 345/695; 345/694; 345/89

(58) Field of Classification Search ..... 345/89, 345/90, 204, 205, 213–215, 694–696, 698–699
See application file for complete search history.

(56) References Cited

U.S. PATENT DOCUMENTS 4,611,283 A * 9/1986 Lumelsky et al. ..... 250/363.07
5,327,264 A * 7/1994 Iyama ..... 358/515
6,184,853 B1 * 2/2001 Hebiguchi et al. ..... 345/88
6,201,612 B1 * 3/2001 Matsushiro et al. ..... 358/1.9
6,219,025 B1 * 4/2001 Hill et al. ..... 345/589
6,225,973 B1 * 5/2001 Hill et al. ..... 345/589
6,239,783 B1 * 5/2001 Hill et al. ..... 345/694
6,278,434 B1 * 8/2001 Hill et al. ..... 345/660
6,307,566 B1 * 10/2001 Hill et al. ..... 345/613
6,577,291 B2 * 6/2003 Hill et al. ..... 345/89
6,693,615 B2 * 2/2004 Hill et al. ..... 345/89
7,286,121 B2 * 10/2007 Duggan et al. ..... 345/204
7,295,765 B1 * 11/2007 Kijima ..... 386/117
7,522,172 B2 * 4/2009 Tanase et al. ..... 345/603
2002/0033809 A1 * 3/2002 Nakajima ..... 345/204
2002/0093476 A1 * 7/2002 Hill et al. ..... 345/89
2002/0186229 A1 * 12/2002 Brown Elliott ..... 345/649
2003/0193515 A1 * 10/2003 Hill et al. ..... 345/695
2005/0012755 A1 * 1/2005 Dresevic et al. ..... 345/581
2007/0086090 A1 * 4/2007 Wang et al. ..... 359/464

* cited by examiner

*Primary Examiner* — Abbas Abdulselam
*Assistant Examiner* — Dmitriy Bolotin
(74) *Attorney, Agent, or Firm* — Innovation Counsel LLP

(57) ABSTRACT

A display apparatus capable of reducing discrepancies between the image data received from the external graphic controller and the image that is actually displayed on the display panel is presented. The display apparatus includes a display panel having horizontal sub-pixels arranged in a first direction and a data modifier that receives image data for vertical sub-pixels arranged in a second direction substantially perpendicular to the first direction from an external graphic controller. The data modifier converts the image data to allow the image data to be applied to the horizontal sub-pixels and precisely display the intended images. The display apparatus displays an image using the modified image data by the data modifier. The display apparatus also includes a timing controller, a data driver, and a gate driver.

10 Claims, 6 Drawing Sheets

Fig. 5

| | | |
|---|---|---|
| R'(m-1,n-1) | R'(m-1,n) | R'(m-1,n+1) |
| G'(m-1,n-1) | G'(m-1,n) | G'(m-1,n+1) |
| B'(m-1,n-1) | B'(m-1,n) | B'(m-1,n+1) |
| R'(m,n-1) | R'(m,n) | R'(m,n+1) |
| G'(m,n-1) | G'(m,n) | G'(m,n+1) |
| B'(m,n-1) | B'(m,n) | B'(m,n+1) |
| R'(m+1,n-1) | R'(m+1,n) | R'(m+1,n+1) |
| G'(m+1,n-1) | G'(m+1,n) | G'(m+1,n+1) |
| B'(m+1,n-1) | B'(m+1,n) | B'(m+1,n+1) |

DISPLAY APPARATUS CAPABLE OF MODIFYING IMAGE DATA FOR IMPROVED DISPLAY

CROSS-REFERENCE TO RELATED APPLICATION

This application relies for priority upon Korean Patent Application No. 2006-92471 filed on Sep. 22, 2006, the content of which is herein incorporated by reference in its entirety.

BACKGROUND OF THE INVENTION

1. Field of the Invention

The present invention relates to a display apparatus. More particularly, the present invention relates to a display apparatus capable of improving display quality.

2. Description of the Related Art

In general, a liquid crystal display includes a display panel on which an image is displayed and a driving circuit that drives the display panel.

Pixels are laid out on the display panel in a matrix configuration, and each of the pixels includes red, green and blue vertical sub-pixels that are arranged in a horizontal direction. An external graphic controller samples image data corresponding to center positions of the red, green and blue vertical sub-pixels and applies the sampled image data to the driving circuit of the liquid crystal display. The driving circuit controls the liquid crystal display such that the display panel displays the image corresponding to the image data.

Recently, each of the pixels is laid out so that it includes red, green and blue horizontal sub-pixels that are arranged in a vertical direction. However, the external graphic controller still samples the image data corresponding to center positions of the red, green and blue vertical sub-pixels and applies the sampled image data to the liquid crystal display having the red, green and blue horizontal sub-pixels.

Accordingly, discrepancies occur between the image data applied by the external graphic controller and the image displayed on a screen of the liquid crystal display having the red, green and blue horizontal sub-pixels. As a result, the liquid crystal display having the horizontal pixel structure is not able to display the image precisely corresponding to the image data from the external graphic controller.

SUMMARY OF THE INVENTION

The present invention provides a display apparatus capable of modifying an image data for a vertical sub-pixel to apply the modified image data to a horizontal sub-pixel.

In one aspect of the present invention, a display apparatus includes a display panel, a data modifier, a timing controller, a data driver and a gate driver. The display panel includes a plurality of pixels, each of which includes red, green and blue horizontal sub-pixels arranged along a first direction. The data modifier receives first, second and third image data for red, green and blue vertical sub-pixels arranged along a second direction substantially perpendicular to a first direction and modifies the first, second and third image data to output the first, second and third modified image data for the red, green and blue horizontal sub-pixels. The timing controller receives the first, second and third modified image data from the data modifier and outputs a data control signal and a gate control signal in response to a control signal from an external device. The data driver receives the first, second and third modified image data from the timing controller in synchronization with the data control signal and converts the first, second and third modified image data into data voltages in order to apply the data voltages to the red, green and blue horizontal sub-pixels. The gate driver sequentially outputs a gate pulse in response to the gate control signal to turn on the red, green and blue horizontal sub-pixels.

In another aspect of the present invention, a display apparatus includes a display panel, a timing controller, a data driver and a gate driver. The display panel includes a plurality of pixels, each of which includes red, green and blue horizontal sub-pixels arranged along a first direction. The timing controller receives first, second and third image data corresponding to red, green and blue vertical sub-pixels arranged along a second direction substantially perpendicular to a first direction and modifies the first, second and third image data to output the first, second and third modified image data for the red, green and blue horizontal sub-pixels. The timing controller outputs a data control signal and a gate control signal in response to a control signal from an external device. The data driver receives the first, second and third modified image data from the timing controller in synchronization with the data control signal and converts the first, second and third modified image data into data voltages in order to apply the data voltages to the red, green and blue horizontal sub-pixels. The gate driver sequentially outputs a gate pulse in response to the gate control signal to turn on the red, green and blue horizontal sub-pixels.

According to the above, image data are applied to the display panel having the horizontal pixel structure after the image data that for the red, green and blue vertical sub-pixels are modifies into data suitable for the red, green and blue horizontal sub-pixels. This way, the display apparatus reduces or prevents the image errors caused by using the image data from the external graphic controller without modifying the image data, thereby precisely displaying the image on the display panel.

BRIEF DESCRIPTION OF THE DRAWINGS

The above and other advantages of the present invention will become readily apparent by reference to the following detailed description when considered in conjunction with the accompanying drawings wherein:

FIG. 5 is a view showing pixels each of which includes color pixels having a horizontal pixel structure.

DESCRIPTION OF THE EMBODIMENTS

Figure 1:
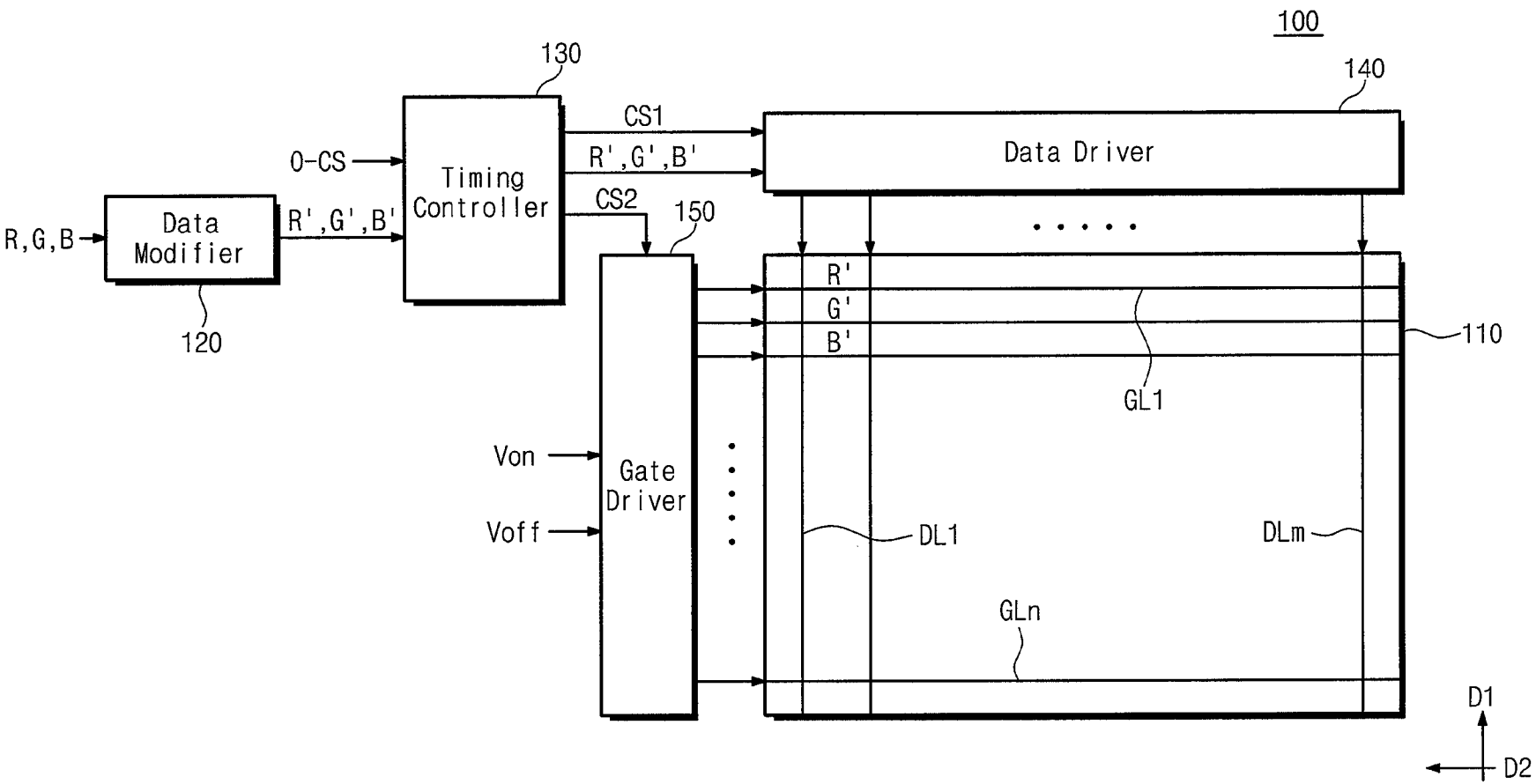
FIG. 1 is a block diagram showing an exemplary embodiment of a display apparatus according to the present invention.

Hereinafter, the present invention will be explained in detail with reference to the accompanying drawings. In the drawings, the thickness of layers, films, and regions are exaggerated for clarity. Like numerals refer to like elements throughout. It will be understood that when an element such as a layer, film, region, or substrate is referred to as being "on" another element, it can be directly on the other element or intervening elements may be present.

Figure 2:
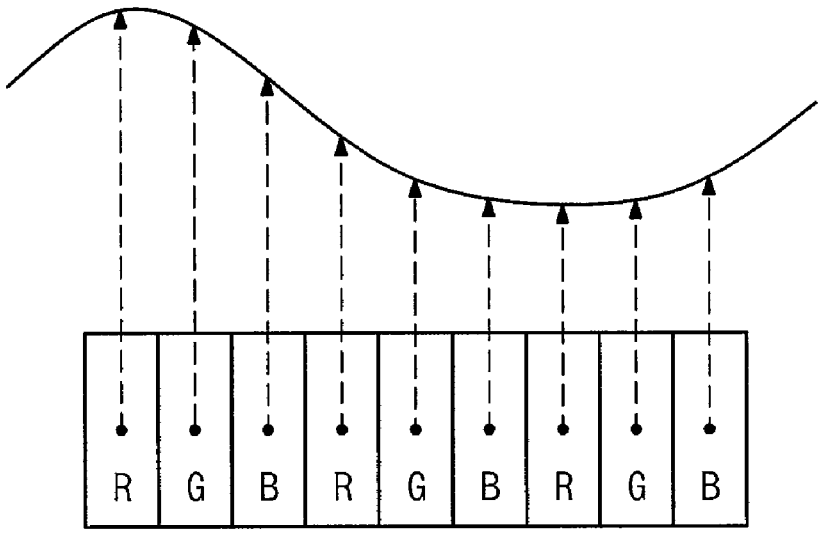
FIG. 2 is a view illustrating a sampling method of red, green and blue image data of FIG. 1.

FIG. 1 is a block diagram showing an exemplary embodiment of a display apparatus according to the present invention, and FIG. 2 is a view illustrating a sampling method of red, green and blue image data as performed by the apparatus of FIG. 1.

Referring to FIG. 1, a display apparatus 100 includes a display panel 110, a data modifier 120, a timing controller 130, a data driver 140 and a gate driver 150.

The display panel 110 includes a plurality of data lines DL1~DLm and a plurality of gate lines GL1~GLn that extend substantially perpendicularly to the data lines DL1~DLm. The data lines DL1~DLm and the gate lines GL1~GLn define a plurality of pixel regions on the display panel 110 in a matrix configuration. Pixels are arranged in the pixel regions. Each of the pixels includes red, green and blue horizontal sub-pixels, each of which has a horizontal structure where the length in a first direction D1 is shorter than the length in a second direction D2. AS shown in FIG. 1, the second direction D2 is substantially perpendicular to the first direction D1.

Although not shown in FIGS. 1 and 2, the display panel 110 includes an array substrate, a color filter substrate facing the array substrate and a liquid crystal layer disposed between the array substrate and the color filter substrate. The red, green and blue horizontal sub-pixels are arranged on the array substrate, and each of the red, green and blue horizontal sub-pixels includes a thin film transistor and a pixel electrode. The red, green and blue horizontal sub-pixels correspond to red, green and blue color pixels arranged on the color filter substrate, respectively.

The data modifier 120 receives red, green and blue image data R, G and B from an external graphic controller (not shown).

As shown in FIG. 2, the external graphic controller samples data values needed to display an image from a stream of data. As shown, the sampled data values correspond to center regions of sub pixels in each pixel. In general, one pixel includes red, green and blue vertical sub-pixels of which the length in the first direction D1 is longer than the length in the second direction D2. Thus, the external graphic controller samples the data values that correspond to the center regions of the red, green and blue vertical sub-pixels. Consequently, the red, green and blue image data R, G and B applied to the display apparatus 100 by the external graphic controller have data values corresponding to the center regions of the red, green and blue vertical sub-pixels.

Referring again to FIG. 1, the data modifier 120 modifies the red, green and blue image data R, G and B received from the external graphic controller to output red, green and blue modified image data R', G' and B' having the data values corresponding to the center positions of the red, green and blue horizontal sub-pixels. The modification method employed by the data modifier 120 will be described in detail with reference to FIGS. 3A to 5.

The timing controller 130 receives the red, green and blue modified image data R', G' and B' from the data modifier 120 and various control signals O-CS from the external graphic controller. The timing controller 130 converts the control signals O-CS into a data control signal CS1 and a gate control signal CS2.

In the present exemplary embodiment, the data control signal CS1 includes a horizontal start signal starting an operation of the data driver 140, a reverse signal reversing a polarity of a data voltage, and an output indication signal determining an output time of the data voltage.

The gate control signal CS2 is applied to the gate driver 150 to control the operation of the gate driver 150. The gate control signal CS2 includes a vertical start signal starting the operation of the gate driver 150, a gate clock signal determining the output time of a gate pulse, and an output enable signal determining the pulse width of the gate pulse.

The data driver 140 receives the red, green and blue modified image data R', G' and B' from the timing controller 130 in synchronization with the data control signal CS1 from the timing controller 130. Also, the data driver 140 receives a gamma reference voltage from a gamma reference voltage generator (not shown) and converts the red, green and blue modified image data R', G' and B' into proper data voltages based on the gamma reference voltage.

The data driver 140 is electrically connected to the data lines DL1~DLm of the display panel 110. Thus, the data voltage output from the data driver 140 is applied to the data lines DL1~DLm.

The gate driver 150 receives a gate-on voltage Von and a gate-off voltage Voff generated from a DC/DC converter (not shown) and sequentially outputs the gate pulse in response to the gate control signal CS2 from the timing controller 130.

The gate driver 150 is electrically connected to the gate lines GL1~GLn of the display panel 110. Thus, the gate pulse output from the gate driver 150 is sequentially applied to the gate lines GL1~GLn.

The red, green and blue horizontal sub-pixels arranged on the display panel 110 are sequentially turned on in response to the gate pulses, so that the red, green and blue horizontal sub-pixels receive the red, green and blue modified image data R', G' and B', respectively. Accordingly, the display panel 110 displays an image corresponding to the data received from the external graphic controller.

Figure 3A:
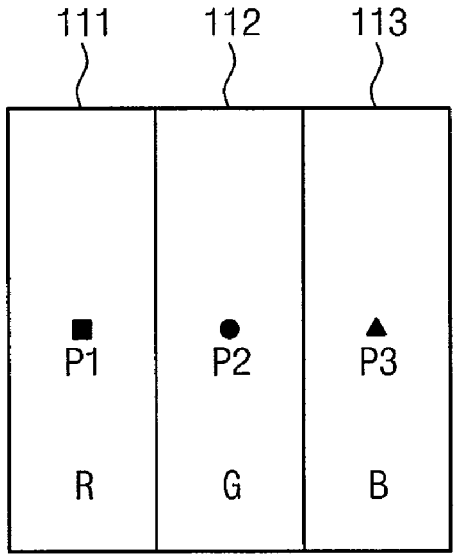
FIG. 3A is a view showing first to third positions respectively corresponding to center positions of red, green and blue vertical sub-pixels from which red, green and blue image data are sampled.
Figure 3B:
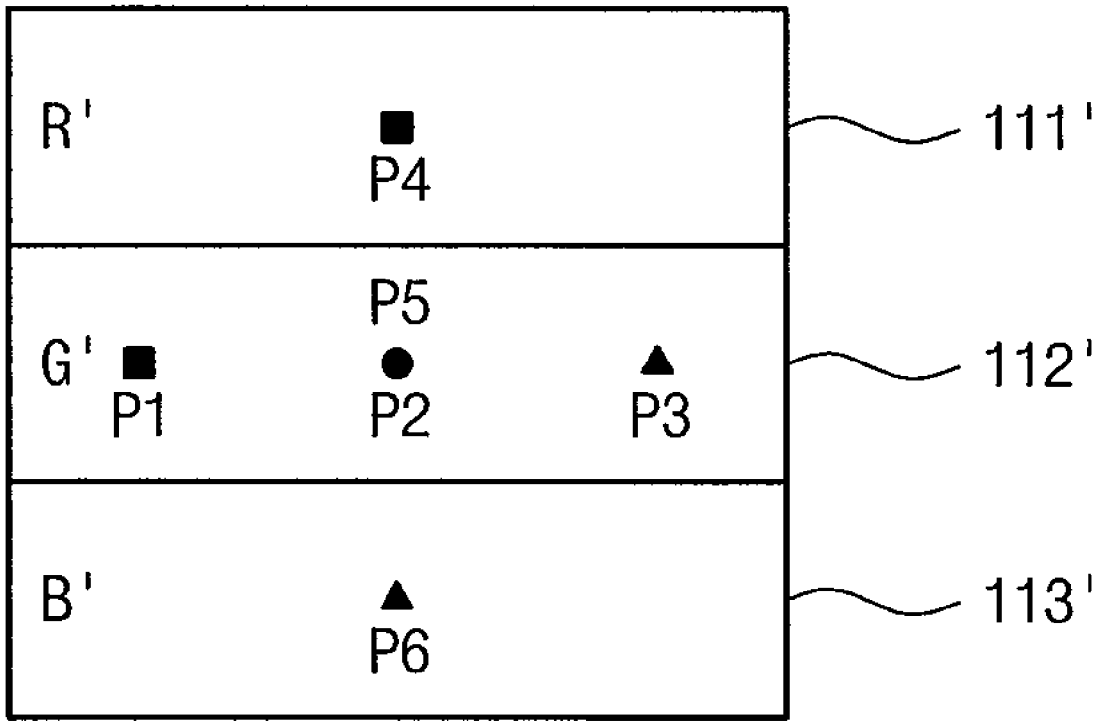
FIG. 3B is a view showing fourth to sixth positions respectively corresponding to center positions of red, green and blue horizontal sub-pixels.

FIG. 3A is a view showing first to third positions respectively corresponding to center positions of red, green and blue vertical sub-pixels from which red, green and blue image data are sampled, and FIG. 3B is a view showing fourth to sixth positions respectively corresponding to center positions of red, green and blue horizontal sub-pixels.

Referring to FIG. 3A, the external graphic controller samples the red, green and blue image data R, G and B from the stream of data such that the sampled data correspond to first, second and third positions P1, P2 and P3 of the red, green and blue vertical sub-pixels 111, 112 and 113, respectively. The first, second and third positions P1, P2 and P3 correspond to the center positions of the red, green and blue vertical sub-pixels 111, 112 and 113, respectively.

The sampled red, green and blue image data R, G and B are applied to the display apparatus 100 (shown in FIG. 1) from the external graphic controller. Since each pixel of the display apparatus 100 includes the red, green and blue horizontal sub-pixels, the red, green and blue image data R, G and B are modified by the data modifier 120 (shown in FIG. 1) into the red, green and blue modified image data R', G' and B' before being applied to the data driver 140 (shown in FIG. 1).

As shown in FIG. 3B, the red, green and blue modified image data R', G' and B' are the data corresponding to fourth, fifth and sixth positions P4, P5 and P6 of the red, green and blue horizontal sub-pixels 111', 112' and 113'. In the present exemplary embodiment, the fourth, fifth and sixth positions P4, P5 and P6 correspond to the center positions of the red, green and blue horizontal sub-pixels 111', 112' and 113, respectively.

The second position P2 corresponding to the center region of the green vertical sub-pixel 112 coincides with the fifth position P5 corresponding to the center region of the green horizontal sub-pixel 112', but the first and third positions P1 and P3 corresponding to the center regions of the red and blue vertical sub-pixels 111 and 113 are different from the fourth and sixth positions P4 and P6 corresponding to the center regions of the red and blue horizontal sub-pixels 111' and 113'. More specifically, the first and third positions P1, P3 of the red and blue vertical sub-pixels 111, 113 are spaced apart from the fourth and sixth positions P4, P6 by predetermined distances.

Thus, when the red, green and blue image data R, G and B corresponding to the first, second and third positions P1, P2 and P3 are applied to the red, green and blue horizontal sub-pixels 111', 112' and 113', respectively, discrepancies occur between the image displayed on the display apparatus 100 and the data applied from the external graphic controller, causing image errors.

The invention reduces or even eliminates these image errors by modifying or translating the image data R, G, B that is intended for the vertical sub-pixels 111, 112, 113 to produce the modified image data R', G', B' for the horizontal sub-pixels 111', 112', 113' such that any discrepancy between the resulting images is minimized. Hereinafter, a calculation process of the modified image data R', G' and B' through the data modifier 120 will be described in detail with reference to FIGS. 4 and 5.

Figure 4:
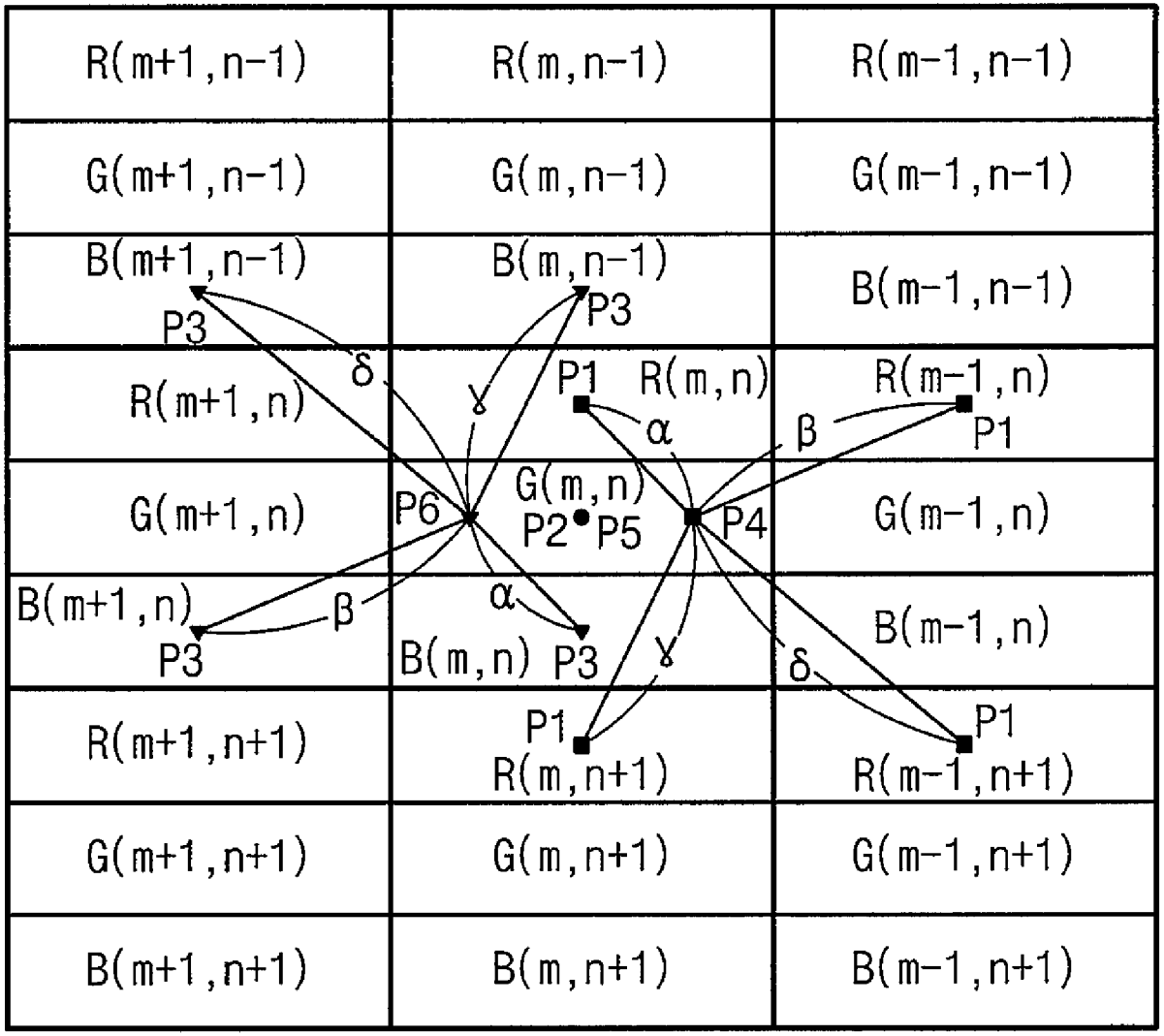
FIG. 4 is a view showing pixels each of which includes color pixels having a vertical pixel structure.

FIG. 4 is a view showing pixels, each of which includes colored sub-pixels having a vertical pixel structure. FIG. 5 is a view showing pixels, each of which includes colored sub-pixels having a horizontal pixel structure. In FIGS. 4 and 5, a calculation process of the modified image data suitable for a (m×n)th pixel among the pixels will be described.

Referring to FIGS. 4 and 5, the (m×n)th pixel (herein also referred to as the "preselected pixel") and eight pixels adjacent to the (m×n)th pixel are shown. In FIG. 4, each pixel includes the red, green and blue vertical sub-pixels of the vertical pixel structure. Similarly, in FIG. 5, each pixel includes the red, green and blue horizontal sub-pixels of the horizontal pixel structure. FIG. 4 shows the first through sixth pixel positions P1, P2, P3, P4, P5, P6 of FIGS. 3A and 3B superimposed on the vertical sub-pixels.

The red modified image data R'(m,n) applied to the (m×n) th red horizontal sub-pixel is generated based on the red image data of the (m×n)th red vertical sub-pixel and the red vertical sub-pixels adjacent to the (m×n)th red vertical sub-pixel.

To determine the red modified image data R'(m,n), the fourth position P4 corresponding to the center region of the (m×n)th red horizontal sub-pixel and the red vertical sub-pixels arranged within a predetermined distance from the fourth position P4 are selected. In the present exemplary embodiment, (m×n)th, ((m−1)×n)th, ((m−1)×(n+1))th and (m×(n+1))th red vertical sub-pixels are selected. The red modified image data R'(m,n) applied to the (m×n)th red horizontal sub-pixel is calculated by a weighted average of the first, second, third and fourth red image data R(m,n), R(m−1,n), R(m,n+1) and R(m−1,n+1) corresponding to the (m×n) th, ((m−1)×n)th, (m×(n+1))th and ((m−1)×(n+1))th red vertical sub-pixels, respectively.

Particularly, the red modified image data R'(m,n) satisfies a following equation 1.

$$R'(m,n)=aR(m,n)+bR(m-1,n)+cR(m,n+1)+dR(m-1,n+1) \quad \text{Equation 1}$$

In equation 1, R'(m,n) is the red modified image data, R(m,n) is the first red image data corresponding to the (m×n) th red vertical sub-pixel, R(m−1,n) is the second red image data corresponding to the ((m−1)×n)th red vertical sub-pixel, R(m,n+1) is the third red image data corresponding to the (m×(n+1))th red vertical sub-pixel, and R(m−1,n+1) is the fourth red image data corresponding to the ((m−1)×(n+1))th red vertical sub-pixel.

The coefficients a, b, c and d are defined as weights of the first, second, third and fourth red image data R(m,n), R(m−1,n), R(m,n+1) and R(m−1,n+1), respectively. The coefficients a, b, c and d have different values from each other in accordance with the distances between the fourth position P4 and the first position P1 of the (m×n)th, ((m−1)×n)th, (m×(n+1))th and ((m−1)×(n+1))th red vertical sub-pixels.

As shown in FIG. 4, the fourth position P4 and the first position P1 of the (m×n)th red vertical sub-pixel are spaced apart from each other by a first distance (a), the fourth position P4 and the first position P1 of the ((m−1)×n)th red vertical sub-pixel are spaced apart from each other by a second distance (α), the fourth position P4 and the first position P1 of the ((m×(n+1))th red vertical sub-pixel are spaced apart from each other by a third distance (γ), and the fourth position P4 and the first position P1 of the ((m−1)×(n+1))th red vertical sub-pixel are spaced apart from each other by a fourth distance (δ). The values of the first, second, third and fourth distances (α, β, γ, δ) become increasingly larger in that order.

As an example of the present embodiment, the values of the coefficients a, b, c and d become increasingly smaller in that order as the weights of the first, second, third and fourth red image data R(m,n), R(m−1,n), R(m,n+1) and R(m−1,n+1). That is, the weights of the first, second, third and fourth red image data R(m,n), R(m−1,n), R(m,n+1) and R(m−1,n+1) are inversely proportional to the first, second, third and fourth distances (α, β, γ, δ).

Meanwhile, the (m×n)th green horizontal sub-pixel is positioned at a center of the (m×n)th pixel (i.e. between the (m×n)th red horizontal sub-pixel and the (m×n)th blue horizontal sub-pixel). Thus, the fifth position P5 corresponding to the center region of the (m×n)th green horizontal sub-pixel corresponds to the center region of the (m×n)th pixel. The (m×n)th green vertical sub-pixel is positioned at a center of the (m×n)th pixel (i.e. between the (m×n)th red vertical sub-pixel and the (m×n)th blue vertical sub-pixel). Thus, the second position P2 corresponding to the center position of the (m×n)th green vertical sub-pixel corresponds to the center position of the (m×n)th pixel. Consequently, the second position P2 and the fifth position P5 are the same.

Thus, the first green modified image data G'(m,n) corresponding to the (m×n)th green horizontal sub-pixel has the same value as that of the first green image data G(m,n) that is sampled suitable for the (m×n)th green vertical sub-pixel. Therefore, the data modifier 120 (shown in FIG. 1) outputs the first green image data G(m,n) as the first green modified image data G'(m,n) without any modification.

The blue modified image data B'(m,n) for the (m×n)th blue horizontal sub-pixel is generated based on the image data of the (m×n)th blue vertical sub-pixel and the blue vertical sub-pixels adjacent to the (m×n)th blue vertical sub-pixel.

To determine the blue modified image data B'(m,n), the sixth position P6 corresponding to the center position of the (m×n)th blue horizontal sub-pixel and the blue vertical sub-pixels arranged within a predetermined distance from the sixth position P6 are selected. In the present exemplary embodiment, (m×n)th, ((m+1)×n)th, (m×(n−1))th and ((m+1)×(n−1))th blue vertical sub-pixels are selected. The blue modified image data B'(m,n) applied to the (m×n)th blue horizontal sub-pixel is calculated by a weighted average of the first, second, third and fourth blue image data B(m,n), B(m+1,n), B(m,n−1) and B(m+1,n−1) corresponding to the (m×n)th, ((m+1)×n)th, (m×(n−1))th and ((m+1)×(n−1))th blue vertical sub-pixels, respectively.

Particularly, the blue modified image data B'(m,n) satisfies the following equation 2.

$$B'(m,n)=a'B(m,n)+b'B(m+1,n)+c'B(m,n-1)+d'B(m+1,n-1) \quad \text{Equation 2}$$

In equation 2, B'(m,n) is the blue modified image data, B(m,n) is the first blue image data corresponding to the (m×n) th blue vertical sub-pixel, B(m+1,n) is the second blue image data corresponding to the ((m+1)×n)th blue vertical sub-pixel, B(m,n−1) is the third blue image data corresponding to the (m×(n−1))th blue vertical sub-pixel, and B(m+1,n11) is the fourth blue image data corresponding to the ((m+1)×(n−1))th blue vertical sub-pixel.

The coefficients a', b', c' and d' are defined as weights of the first, second, third and fourth blue image data B(m,n), B(m+1,n), B(m,n−1) and B(m+1,n−1), respectively. The coefficients a', b', c' and d' have different values from each other in accordance with the distances between the sixth position P6 and the third position P3 of the (m×n)th, ((m+1)×n)th, (m×(n−1))th and ((m+1)×(n−1))th blue vertical sub-pixels.

As shown in FIG. 4, the sixth position P6 and the third position P3 of the (m×n)th blue vertical sub-pixel are spaced apart from each other by the first distance (a), the sixth position P6 and the third position P3 of the ((m+1)×n)th blue vertical sub-pixel are spaced apart from each other by the second distance (p), the sixth position P6 and the third position P3 of the ((m×(n−1))th blue vertical sub-pixel are spaced apart from each other by the third distance (γ), and the sixth position P6 and the third position P3 of the ((m+1)×(n−1))th blue vertical sub-pixel are spaced apart from each other by the fourth distance (δ). The values of the first, second, third and fourth distances (α, β, γ, δ) become increasingly larger in that order.

As an example of the present embodiment, the values of the coefficients a', b', c' and d' become increasingly smaller in that order as the weights of the first, second, third and fourth blue image data B(m,n), B(m+1,n), B(m,n−1) and B(m+1,n−1). That is, the weights of the first, second, third and fourth blue image data B(m,n), B(m+1,n), B(m,n−1) and B(m+1,n−1) are inversely proportional to the first, second, third and fourth distances (α, β, γ, δ).

The red, green and blue modified image data R'(m,n), G'(m,n) and B'(m,n) calculated by the above-described process are applied to the timing controller 130 (shown in FIG. 1) and used to display the image on the display panel 110 having the horizontal pixel structure. Thus, the display apparatus 100 may prevent the image errors caused by using the image data from the external graphic controller without modifying the image date, thereby precisely displaying the image on the display panel 110.

Figure 6:
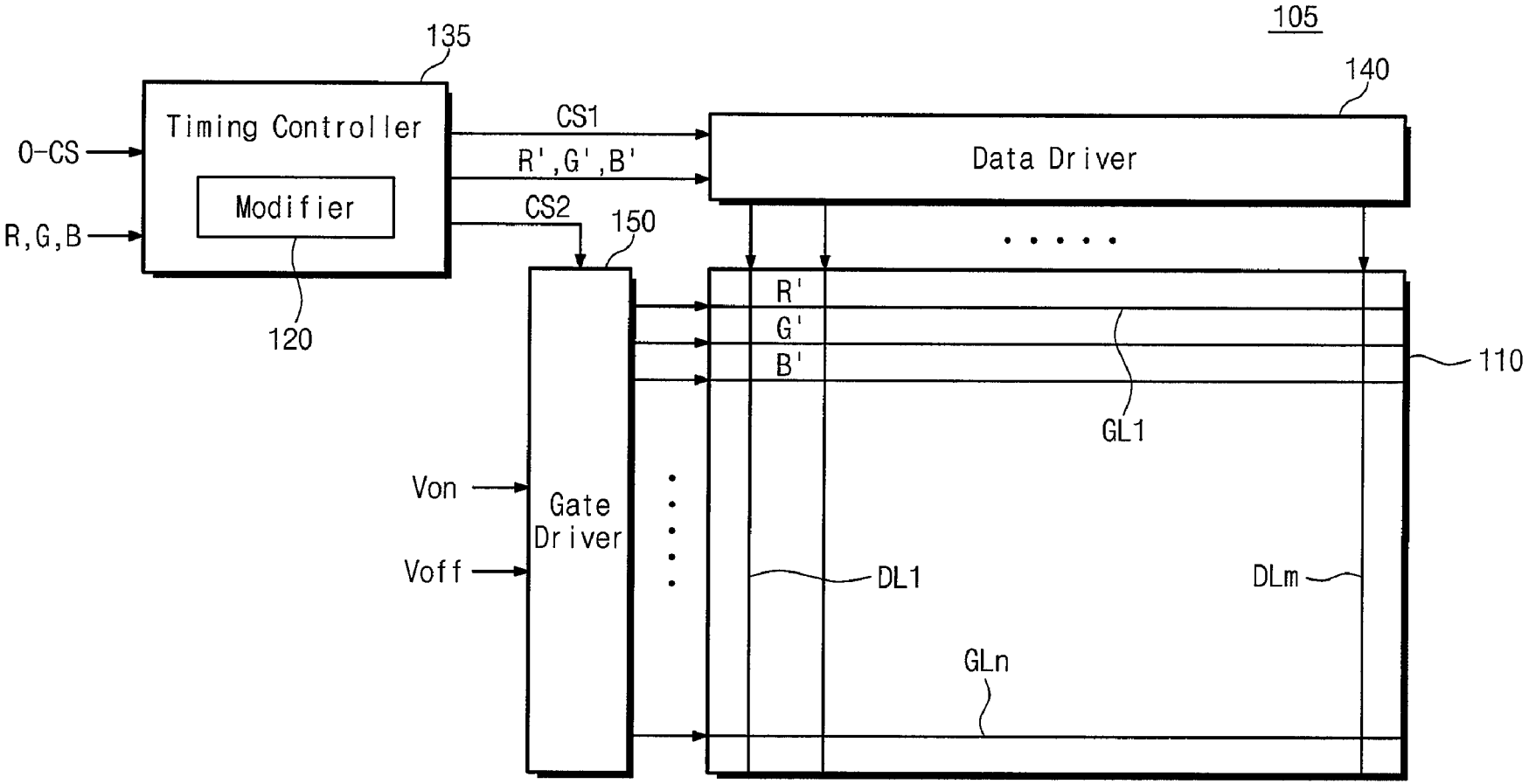
FIG. 6 is a block diagram showing another exemplary embodiment of a liquid crystal display according to the present invention.

FIG. 6 is a block diagram showing another exemplary embodiment of a liquid crystal display according to the present invention. In FIG. 6, the same reference numerals denote the same elements in FIG. 1, and thus any redundant descriptions of the same elements will be omitted.

Referring to FIG. 6, a display apparatus 105 includes a display panel 110, a timing controller 135, a data driver 140 and a gate driver 150.

The timing controller 135 receives various control signals, and red, green and blue image data R, G and B from an external graphic controller. The timing controller 135 includes a data modifier 120. The data modifier 120 installed in the timing controller 135 modifies the red, green and blue image data R, G and B to output red, green and blue modified image data R', G' and B'.

The data driver 140 receives the red, green and blue modified image data R', G' and B' from the timing controller 130 and converts the red, green and blue modified image data R', G' and B' into proper data voltages.

Red, green and blue horizontal sub-pixels arranged on the display panel 110 receive the data voltage corresponding to the red, green and blue modified image data R', G' and B', respectively, to display an image corresponding to the data from the external graphic controller.

Although not shown in FIG. 6, the gate driver 150 may be directly formed on the display panel 110 through a thin film process that forms pixels on the display panel 110. The data driver 140 is prepared in the form of a chip, so that the data driver 140 may be mounted on a film attached to the display panel 110 or directly mounted on the display panel 110.

According to the display apparatus of the invention, image data are applied to the display panel having the horizontal pixel structure after the image data that are sampled for the red, green and blue vertical sub-pixels are converted into modified image data suitable for the red, green and blue horizontal sub-pixels. This way, the display apparatus prevents image errors caused by using the image data from the external graphic controller without modifying the image data, thereby precisely displaying the image on the display panel.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus comprising:

a display panel comprising a plurality of pixels, each of which comprises red, green and blue horizontal sub-pixels, each of the horizontal sub-pixels having a first side extending along a first direction and a second side extending along a second direction substantially perpendicular to the first direction, the second side being shorter than the first side;

a data modifier configured to receive first, second and third image data for red, green and blue vertical sub-pixels each having a first side extending along the first direction and a second side extending along the second direction, the second side being longer than the first side, the data modifier configured to modify the first, second and third image data, and to output first, second and third modified image data for the red, green and blue horizontal sub-pixels;

a timing controller configured to receive the first, second and third modified image data from the data modifier and to output a data control signal and a gate control signal in response to a control signal from an external device;

a data driver configured to receive the first, second and third modified image data from the timing controller in synchronization with the data control signal, to convert the first, second and third modified image data into data voltages, and to apply the data voltages to the red, green and blue horizontal sub-pixels; and a gate driver configured to sequentially output a gate pulse in response to the gate control signal to turn on the red, green and blue horizontal sub-pixels, wherein the first, second and third image data are defined as data values corresponding to first, second and third positions at center regions of the red, green and blue vertical sub-pixels, respectively, the first, second and third modified image data are defined as data values corresponding to fourth, fifth and sixth positions at center regions of the red, green and blue horizontal sub-pixels, respectively, wherein the second and fifth positions are the same, and wherein the data modifier is further configured to:

generate the first modified image data based on a first image data of a preselected pixel among the pixels and a first image data of at least three pixels adjacent to the preselected pixel;

output a second image data of the preselected pixel as the second modified image data; and generate the third modified image data based on a third image data of the preselected pixel and a third image data of at least three pixels adjacent to the preselected pixel.

2. The display apparatus of claim 1, wherein the first modified image data is calculated by a weighted average of the first image data of the preselected pixel and the first image data corresponding to a first position of first, second and third adjacent pixels arranged within a predetermined distance from a fourth position of the preselected pixel among the adjacent pixels, and the first modified image data satisfies the following first modification equation, $$R'(m,n)=aR(m,n)+bR(m-1,n)+cR(m,n+1)+dR(m-1,n+1)$$

where R(m,n) is the first image data of the preselected pixel, R(m−1,n) is the first image data of the first adjacent pixel, R(m,n+1) is the first image data of the second adjacent pixel, and R(m−1,n+1) is the first image data of the third adjacent pixel, and a, b, c and d are weights of the first image data corresponding to the preselected pixel, first adjacent pixel, second adjacent pixel and third adjacent pixel, respectively.

3. The display apparatus of claim 2, wherein a first position of the preselected pixel is spaced apart from the fourth position of the preselected pixel by a first distance, the first position of the first adjacent pixel is spaced apart from the fourth position of the preselected pixel by a second distance, the first position of the second adjacent pixel is spaced apart from the fourth position of the preselected pixel by a third distance, the first position of the third adjacent pixel is spaced apart from the fourth position of the preselected pixel by a fourth distance, the first, second, third and fourth distances become increasingly larger in that order, and the a, b, c and d become increasingly smaller in that order.

4. The display apparatus of claim 1, wherein the third modified image data is calculated by a weighted average of the third image data of the preselected pixel and the third image data corresponding to a third position of fourth, fifth and sixth adjacent pixels arranged within a predetermined distance from a sixth position of the preselected pixel among the adjacent pixels, and the third modified image data satisfies a following second modification equation, $$B'(m,n)=a'B(m,n)+b'B(m+1,n)+c'B(m,n-1)+d'B(m+1,n-1)$$

where B(m,n) is the third image data of the preselected pixel, B(m+1,n) is the third image data of the fourth adjacent pixel, B(m,n−1) is the third image data of the fifth adjacent pixel, and B(m+1,n−1) is the third image data of the sixth adjacent pixel, and a', b', c' and d' are weights of the third image data corresponding to the preselected pixel, fourth adjacent pixel, fifth adjacent pixel and sixth adjacent pixel, respectively.

5. The display apparatus of claim 4, wherein a third position of the preselected pixel is spaced apart from the sixth position of the preselected pixel by a first distance, the third position of the fourth adjacent pixel is spaced apart from the sixth position of the preselected pixel by a second distance, the third position of the fifth adjacent pixel is spaced apart from the sixth position of the preselected pixel by a third distance, the third position of the sixth adjacent pixel is spaced apart from the sixth position of the preselected pixel by a fourth distance, the first, second, third and fourth distances become increasingly larger in that order, and the a', b', c' and d' become increasingly smaller in that order.

6. A display apparatus comprising:

a display panel comprising a plurality of pixels, each of which comprises red, green and blue horizontal sub-pixels, each of the horizontal sub-pixels having a first side extending along a first direction and a second side extending along a second direction substantially perpendicular to the first direction, the second side being shorter than the first side;

a timing controller configured to receive first, second and third image data for red, green and blue vertical sub-pixels, each of the vertical sub-pixels having a first side extending along the first direction and a second side extending along the second direction, the second side being longer than the first side, the timing controller configured to modify the first, second and third image data, and outputting first, second and third modified image data for the red, green and blue horizontal sub-pixels, and outputting a data control signal and a gate control signal in response to a control signal from an external device;

a data driver configured to receive the first, second and third modified image data from the timing controller in synchronization with the data control signal, converting the first, second and third modified image data into data voltages, and applying the data voltages to the red, green and blue horizontal sub-pixels; and a gate driver configured to sequentially output a gate pulse in response to the gate control signal to turn on the red, green and blue horizontal sub-pixels, wherein the timing controller comprises a data modifier that modifies the first, second and third image data to output the first, second and third modified image data, the first, second and third image data are defined as data values corresponding to first, second and third positions at center regions of the red, green and blue vertical sub-pixels, respectively, and the first, second and third modified image data are defined as data values corresponding to fourth, fifth and sixth positions at center regions of the red, green and blue horizontal sub-pixels, respectively, and the data modifier is further configured to:

generate the first modified image data based on a first image data of a preselected pixel among the pixels and a first image data of at least three pixels adjacent to the preselected pixel;

output a second image data of the preselected pixel as the second modified image data; and generate the third modified image data based on a third image data of the preselected pixel and a third image data of at least three pixels adjacent to the preselected pixel.

7. The display apparatus of claim 6, wherein the first modified image data is calculated by a weighted average of the first image data of the preselected pixel and the first image data corresponding to a first position of first, second and third adjacent pixels arranged within a predetermined distance from a fourth position of the preselected pixel among the adjacent pixels, and the first modified image data satisfies a following first modification equation, $$R'(m,n)=aR(m,n)+bR(m-1,n)+cR(m,n+1)+dR(m-1,n+1)$$

where R(m,n) is the first image data of the preselected pixel, R(m−1,n) is the first image data of the first adjacent pixel, R(m,n+1) is the first image data of the second adjacent pixel, and R(m−1,n+1) is the first image data of the third adjacent pixel, and a, b, c and d are weights of the first image data corresponding to the preselected pixel, first adjacent pixel, second adjacent pixel and third adjacent pixel, respectively.

8. The display apparatus of claim 7, wherein a first position of the preselected pixel is spaced apart from the fourth position of the preselected pixel by a first distance, the first position of the first adjacent pixel is spaced apart from the fourth position of the preselected pixel by a second distance, the first position of the second adjacent pixel is spaced apart from the fourth position of the preselected pixel by a third distance, the first position of the third adjacent pixel is spaced apart from the fourth position of the preselected pixel by a fourth distance, the first, second, third and fourth distances become increasingly larger in that order, and the a, b, c and d become increasingly smaller in that order.

9. The display apparatus of claim 6, wherein the third modified image data is calculated by a weighted average of the third image data of the preselected pixel and the third image data corresponding to a third position of fourth, fifth and sixth adjacent pixels arranged within a predetermined distance from a sixth position of the preselected pixel among the adjacent pixels, and the third modified image data satisfies a following second modification equation, $$B'(m,n)=a'B(m,n)+b'B(m+1,n)+c'B(m,n-1)+d'B(m+1,n-1)$$

where B(m,n) is the third image data of the preselected pixel, B(m+1,n) is the third image data of the fourth adjacent pixel, B(m,n−1) is the third image data of the fifth adjacent pixel, and B(m+1,n−1) is the third image data of the sixth adjacent pixel, and a', b', c' and d' are weights of the third image data corresponding to the preselected pixel, fourth adjacent pixel, fifth adjacent pixel and sixth adjacent pixel, respectively.

10. The display apparatus of claim 9, wherein a third position of the preselected pixel is spaced apart from the sixth position of the preselected pixel by a first distance, the third position of the fourth adjacent pixel is spaced apart from the sixth position of the preselected pixel by a second distance, the third position of the fifth adjacent pixel is spaced apart from the sixth position of the preselected pixel by a third distance, the third position of the sixth adjacent pixel is spaced apart from the sixth position of the preselected pixel by a fourth distance, the first, second, third and fourth distances become increasingly larger in that order, and the a', b', c' and d' become increasingly smaller in that order.

* * * * *